United States Patent [19]

Anhalt et al.

[11] Patent Number: 4,641,903

[45] Date of Patent: Feb. 10, 1987

[54] INSULATION DISPLACEMENT CONNECTOR

[75] Inventors: John W. Anhalt, Orange; Michael K. Cabourne, Hacienda Heights, both of Calif.

[73] Assignee: International Telephone and Telegraph Corporation, New York, N.Y.

[21] Appl. No.: 565,561

[22] Filed: Dec. 27, 1983

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS 4,381,132 4/1983 Tournier ..... 339/99 R

*Primary Examiner*—Joseph H. McGlynn

*Attorney, Agent, or Firm*—T. L. Peterson; R. C. Turner

[57] ABSTRACT

An insulation displacement connector is disclosed which is particularly adapted for use with flat cable having very closely spaced conductors. The connector contains two rows of contacts. The contacts in the two rows are staggered relative to each other. Each contact has a slotted plate for engaging one of the conductors of the cable. Adjacent contacts in each row of contacts are rotated 180° relative to each other so that the slotted plates of the contacts in each row are also staggered relative to each other for facilitating feeding every second conductor of the flat cable laterally between the slotted plates of one row of contacts to the slotted plates of the other row.

5 Claims, 11 Drawing Figures

INSULATION DISPLACEMENT CONNECTOR

BACKGROUND OF THE INVENTION

The present invention relates generally to an electrical connector and, more particularly, to an insulation displacement connector for flat cables.

Mass termination techniques utilizing insulation displacement connectors have become commonplace throughout the industry. Such techniques allow rapid interconnections to be made between the conductors of a flat cable and the contacts of the connector by simply clamping the cable between the connector cap and housing thereby forcing the cable conductors into slots in the contacts. Generally, the termination ends of the contacts are in the form of slotted plates. The slotting of the contact plate provides what might be considered to be a double tine termination system in which each tine of the slotted contact is located on opposite sides of the cable conductor.

In order to facilitate the connecting of the contacts to closely spaced conductors in a flat cable, the contacts are generally mounted in two rows with the contacts in one row staggered with respect to the contacts in the other row. Connectors having contacts arranged in this fashion are disclosed in U.S. Pat. Nos. 3,820,055; 4,068,912 and 4,118,096.

Recently, flat cables have become available in which the conductors are spaced apart only 0.025 inch. Because of the width of the tines of the contacts, and the very close spacing of the contacts required by the close spacing of the conductors, it becomes very difficult to feed alternate conductors of the cable between the contacts in one row to the contacts in the second row of contacts for termination thereto. As a consequence, occasionally the feedthrough conductors of the flat cable become shorted by the contacts in the first row.

It is the object of the present invention to overcome the aforementioned problem of shorting of feedthrough conductors of a flat cable utilized with an insulation displacement connector even when the spacing between the contacts is very small.

SUMMARY OF THE INVENTION

According to a principal aspect of the present invention, there is provided an insulation displacement connector in which the housing or insulator of the connector contains two rows of staggered contacts wherein the contacts in each row have their insulation displacementconductor engaging termination portions also staggered relative to each other. By this arrangement there is provided a set of four contacts for each group of four conductors of the flat cable wherein the contacts are uniquely spaced along the cable axis. The termination portions of the contacts in each set are all staggered relative to each other which provides greater clearance between the termination portions of the contacts and, hence, facilitates the feeding of feedthrough conductors of the cable between the termination portions of the contacts in one row to the termination portions of the contacts in the second row. Preferably, the staggering of the termination portions of the contacts in each row is achieved by designing the contacts so that the termination portions thereof are offset from the center axes of the contacts, and by rotating adjacent contacts in each row 180° about their axes with respect to each other. By such an arrangement, identical contacts may be utilized in all the contact cavities in the connector insulator.

DESCRIPTION OF THE PREFERRED EMBODIMENT

Figure 1:
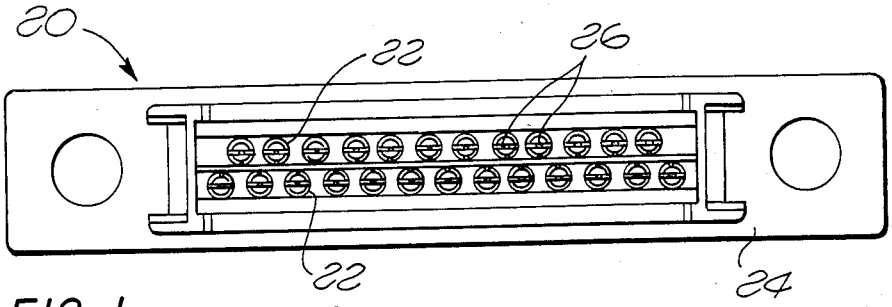
FIG. 1 PRIOR ART.
FIG. 1 is a rear end view of a conventional insulation displacement connector.

Reference is first made to FIG. 1 of the drawings which illustrates a typical prior art insulation displacement connector 20 in which two parallel rows of contacts 22 are mounted in the connector housing or insulator 24. The contacts in the two rows are staggered relative to each other so that alternate conductors of a flat cable, not shown, can be fed between the contacts in one row to the contacts in the second row for termination thereto. Each contact embodies a slotted flat rear termination portion 26. The termination portion of each contact is located on the center axis of the contact, and the termination portions of all the contacts in each row lie in a common plane. Thus, the termination portions of the contacts in each row are positioned relatively close to each other, thus making it difficult to feed the feedthrough conductors of the flat cable between the termination portions of the contacts in the first row to the second row of contacts with the result that occasionally shorting of the feedthrough conductors occurs by the contacts in the first row. This problem is overcome by the connector of the present invention.

Figure 2:
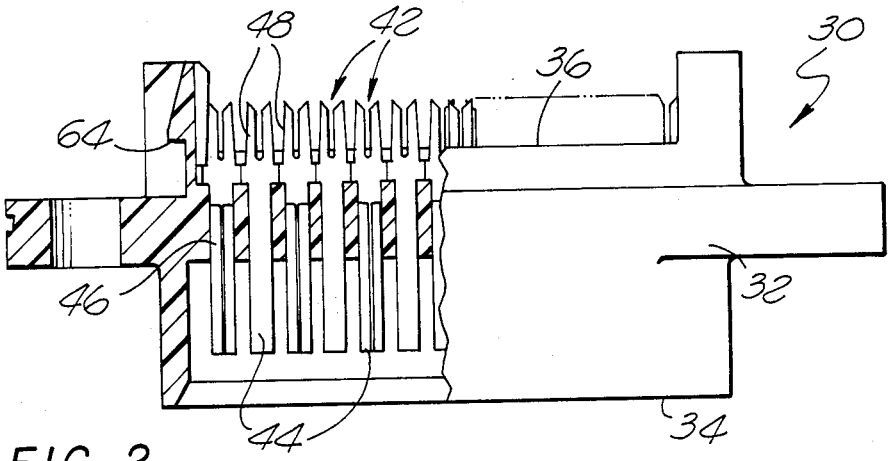
FIG. 2 is a partial longitudinal sectional view through the connector of the present invention.
Figure 3:
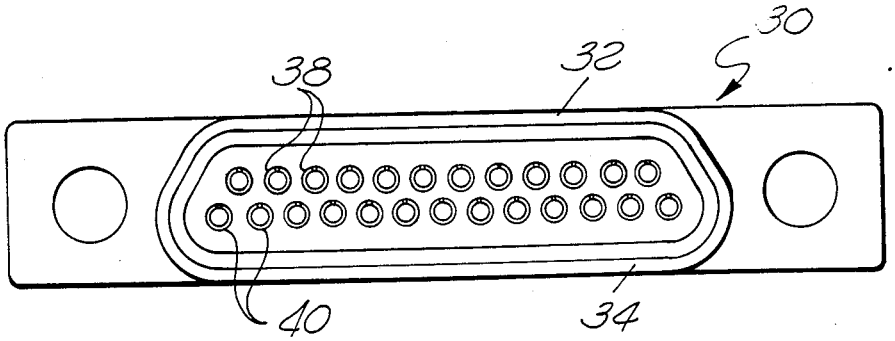
FIG. 3 is a front end view of the connector illustrated in FIG. 2.

Referring now to FIGS. 2–11, the connector of the present invention, generally designated 30, comprises an insulator 32 having a front 34 and a rearwardly facing surface 36. The insulator contains two rows of contact cavities 38 and 40 which are staggered relative to each other as best seen in FIG. 3. The cavities extend from the front 34 to the rearwardly facing surface 36 of the insulator. Insulation displacement contacts 42 are mounted in the cavities 38 and 40.

Figure 8:
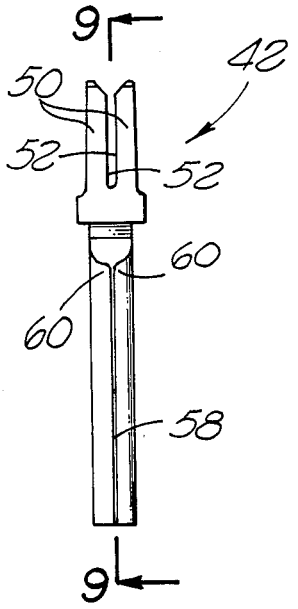
FIG. 8 is a side view of one of the contacts utilized in the connector of the invention.
Figure 9:
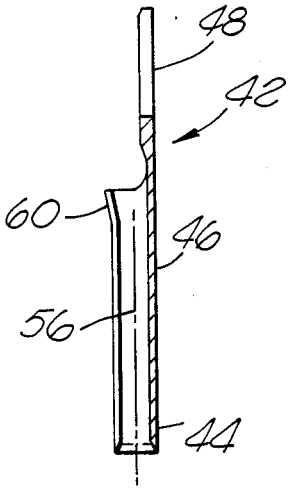
FIG. 9 is a longitudinal sectional view of the contact taken along line 9—9 of FIG. 8.
Figure 10:
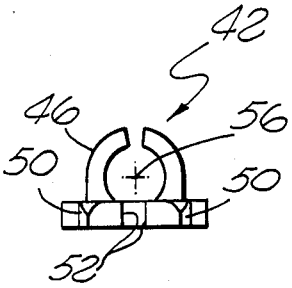
FIG. 10 is a rear end view of the contact.
Figure 11:
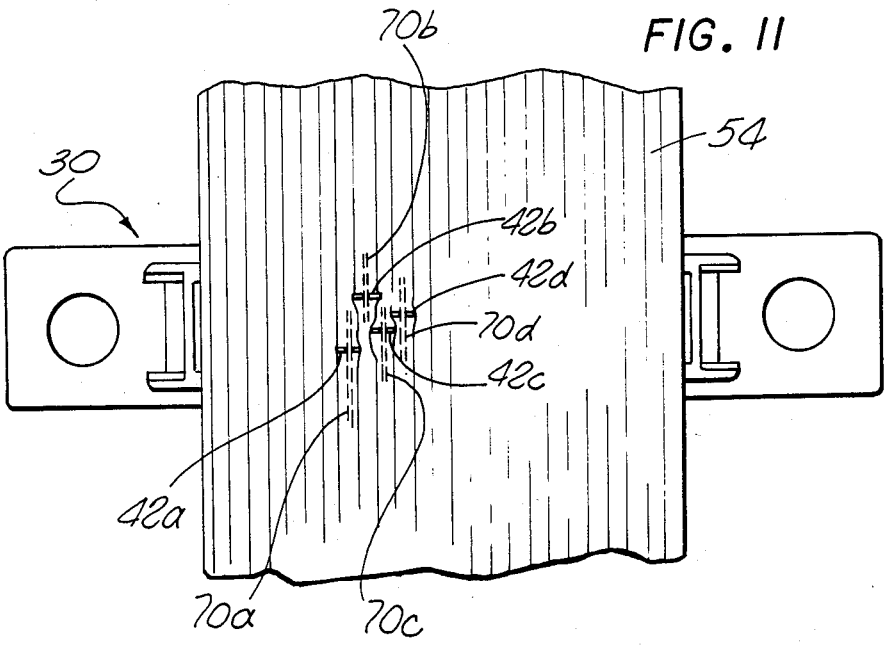
FIG. 11 is a rear view of the connector of the present invention with a flat cable mounted over the rear of the connector showing how the termination portions of the contacts of the connector engage the conductors of the cable.

As best seen in FIGS. 8–10, each contact 42 has a forward mating portion 44, an intermediate hollow mounting portion 46 and a rear insulation displacement-conductor engaging termination portion 48. The contact may be either a pin contact or a socket contact, as shown, wherein the forward mating portion is of hollow, cylindrical form. The hollow mounting portion 46 of the contact constitutes a continuation of the cylindrical mating portion of the contact. The rear termination portion 48 of the contact is a flat slotted plate which extends rearwardly from one side of the hollow mounting portion 46 of the contact. The slotted plate provides two resilient arms or tines 50 having opposed edges 52 for engaging one of the conductors of a flat cable 54, such as illustrated in FIG. 11, when the conductor of the cable is pushed down into the slot formed between the arms. Thus, it is seen that the flat termination portion 48 of the contact is offset to one side of the center axis 56 of the contact. Preferably, the contact is made by stamping and forming a suitable sheet metal material, such as berylium copper. The formed contact provides a longitudinally extending seam 58 in the cylindrical mating portion 44 and mounting portion 46 of the contact. The edges 60 of the mounting portion 46 adjacent to the seam 58 are flared outwardly slightly so as to have an interference fit within the contact cavity in which the contact is mounted.

Figure 4:
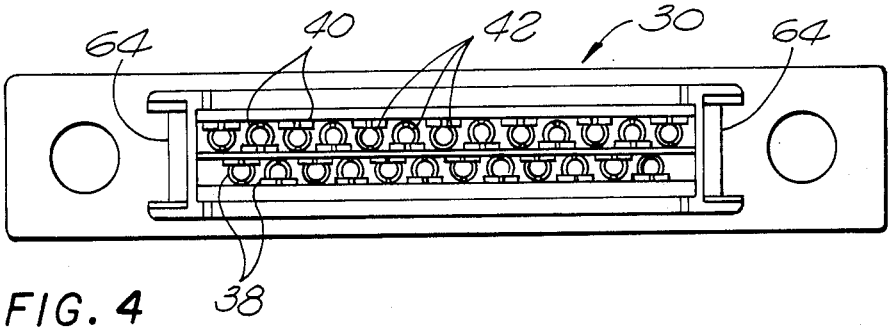
FIG. 4 is a rear end view of the connector illustrated in FIG. 2.
Figure 5:
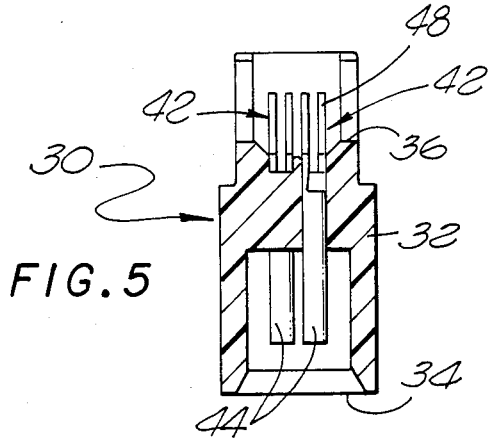
FIG. 5 is a transverse sectional view through the connector of the present invention.

As best seen in FIG. 2, when each contact 42 is mounted in a contact cavity, either 38 or 40, the mounting portion 46 of the contact is disposed in the cavity with the flared portions 60 of the contact having an interference fit with the wall of the cavity. The forward mating portion 44 of the contact extends forwardly toward the front 34 of the insulator, while the rear termination portion 48 of the contact extends rearwardly behind the rearwardly facing surface 36 of the insulator. As best seen in FIG. 4, contacts 42 are mounted in the row of cavities 38 with each contact rotated about its center axis 180° relative to the next adjacent contact, so that the flat terminations 48 of alternate contacts lie in a common plane, and such termination portions are disposed on opposite sides of a plane which runs through the center axes of the row of contacts 42 mounted in the cavities 38. By this arrangement, the flat termination portions 48 of the contacts in each row of cavities 38 are staggered relative to each other. The contacts 42 are mounted in the second row of cavities 40 in the same manner as the contacts are mounted in the cavities 38, so that their termination portions are staggered relative to each other. Thus, by the present invention the contacts are mounted in two rows of cavities in a staggered relationship, and the flat termination portions of the contacts in each row are staggered relative to each other. This arrangement increases the clearance space between the termination portions of adjacent contacts in each row which facilitates the feeding of alternate conductors of a flat cable between the termination portions of the contacts in one row so they may reach the second row of contacts without being shorted by the outer edges of the termination portions of the contacts in the first row inadvertently piercing through the insulation and engaging the cores of the feedthrough conductors.

Figure 6:
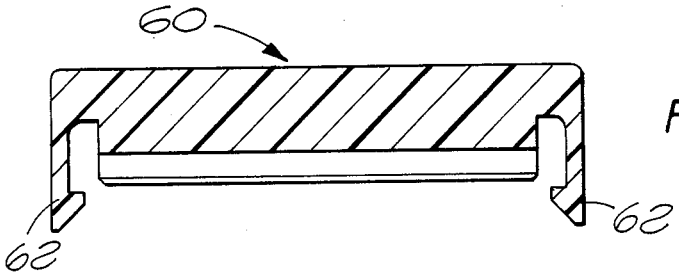
FIG. 6 is a longitudinal sectional view through a cap which may be utilized with the connector of the present invention for securing a flat cable thereon.
Figure 7:
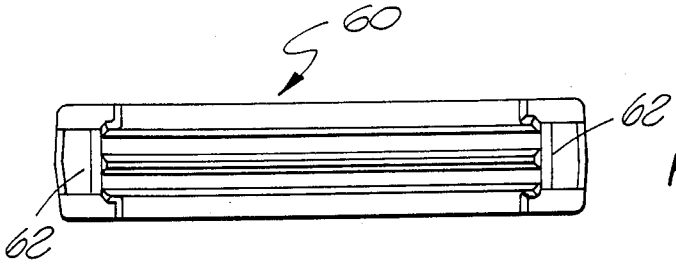
FIG. 7 is a bottom view of the cap.

In FIGS. 6 and 7 there is illustrated a cap 60 which may be utilized to push the flat cable 54 down over the rear termination portions of the contacts in a conventional manner. The cap embodies latch fingers 62 on its opposite ends which engage latch shoulders 64 on the rear of the insulator 32 for retaining the cap on the insulator. Pushing the cap down over the insulator with the cable disposed with its conductors aligned with the slots in the flat termination portions of the contacts will cause the conductors to be pushed down into the slots so that the edges 52 of the arms of the termination portions of the contacts will engage the conductors.

Reference is made to FIG. 11 which illustrates how the contacts in the connector of the present invention engage the conductors of the flat cable 54. The flat cable may be considered as containing a plurality of groups of four conductors 70*a*, 70*b*, 70*c* and 70*d* which are not directly visible because the conductors are covered with an insulation coating. As shown in FIG. 11, the conductors such as 70*a*, 70 *b*, 70 *c*, and 70*d*, engage the connector 30 generally perpendicularly to the central axis of the rows of contacts 42 mounted in the connector. The four conductors of each group are connected to a set of four contacts 42*a*, 42*b*, 42*c* and 42*d*, respectively. The contacts 42*a* and 42*c* are mounted in the lower row of contact cavities, while the contacts 42*b* and 42*d* are mounted in the upper row of cavities. As seen in FIG. 11, the flat termination portions of the four contacts 42*a*, 42*b*, 42*c* and 42*d* engage the conductors 70*a*, 70*b*, 70*c* and 70*d*, respectively, of the flat cable at locations spaced longitudinally along the conductors.

From the foregoing, it is seen that because the flat termination portions of the contacts 42*a* and 42*c* illustrated in FIG. 11 are staggered relative to each other, the space between the termination portions of the contacts is increased, as compared to the arrangement wherein the termination portions of the contacts lie in a common plane, as in the conventional connector illustrated in FIG. 1. Thus, the feedthrough conductors 70*b*, 70*d* of the flat cable may be fed between the adjacent contacts 42 in the lower row with substantially less risk of shorting the feedthrough conductors. This result is achieved without increasing the lateral spacing between the two rows of contacts so that the width of the connector may be maintained at a minimum. Furthermore, by utilizing contacts having flat termination portions which extend rearwardly from one side only of the mounting portions of the contacts, and by rotating adjacent contacts 180° relative to each other, it is possible to utilize identical contacts in all the contact cavities of the connector of the present invention. However, it should be understood that the present invention is not limited to the use of identical contacts. It would also be possible to utilize other forms of contacts so long as the termination portions of the adjacent contacts in each row are staggered relative to each other.

What is claimed is:

1. An electrical connector for a plurality of generally parallel conductors comprising:

an insulator having a front and a rearwardly facing surface;

a row of contact cavities in said insulator extending from said front to said rearwardly facing surface, the center axes of said cavities lying in a common plane;

a contact mounted in each said cavity;

each said contact having a forward mating portion adjacent to said front of said insulator, a mounting portion located in the corresponding cavity, and a rear termination portion extending outwardly from said rearwardly facing surface;

said termination portion of each said contact being bifurcated providing a pair of arms having opposed edges for engaging one of said conductors generally perpendicularly to said rows; and adjacent contacts in said row of cavities having their termination portions disposed on opposite sides of said plane whereby said termination portions are staggered relative to each other for facilitating feeding of conductors laterally between said termination portions of said contacts.

2. An electrical connector as set forth in claim 1 wherein:

said contacts are essentially identical;

the mounting portion of each said contact has a center axis, said termination portion of said contact being offset from said axis; and adjacent contacts in said row of cavities are rotated approximately 180° about their axes with respect to each other.

3. An electrical connector as set forth in claim 1 including:

a second row of said contact cavities in said insulator parallel to said first row;

the cavities in said second row being staggered relative to the cavities in said first row;

the center axes of said cavities in said second row lying in a second common plane;

one of said contacts being mounted in each of said cavities in said second row; and adjacent contacts in said second row of cavities having their termination portions disposed on opposite sides of said second plane.

4. An electrical connector for a plurality of generally parallel conductors comprising:

an insulator containing two rows of contacts arranged along a central axis;

said contacts having insulation displacement-conductor engaging termination portions adapted to be connected to said respective conductors with said conductors arranged generally perpendicularly to said central axis of the rows of contacts;

the contacts of said two rows being staggered relative to each other; and the termination portions of the contacts of each row are staggered relative to each other;

each said contact has a center axis;

the termination portion of each said contact being offset from the center axis of the contact; and adjacent contacts in each said row are rotated approximately 180° about their axes with respect to each other.

5. An electrical connector in combination with a flat cable containing at least one group of four adjacent conductors comprising:

an insulator containing at least one set of four contacts, two contacts of said set being disposed in one row while the other two contacts of said set are disposed in a second row, said rows being transverse and generally perpendicularly to the length of said cable;

each said contact having an insulation displacement-conductor engaging termination portion; and the termination portions of the contacts of said set engaging the four adjacent conductors of said group of conductors of said flat cable at locations spaced longitudinally along said conductors;

each said contact has a center axis;

the termination portion of each said contact is offset from said center axis; and adjacent contacts in each row of said set are rotated approximately 180° about their center axes with respect to each other.

* * * * *